US006379478B1

(12) United States Patent
Farquharson et al.

(10) Patent No.: US 6,379,478 B1
(45) Date of Patent: Apr. 30, 2002

(54) COPPER BASED ALLOY FEATURING PRECIPITATION HARDENING AND SOLID-SOLUTION HARDENING

(75) Inventors: Daniel D. Farquharson, Meriden; David H. Mandle, Wallingford, both of CT (US)

(73) Assignee: The Miller Company, Meriden, CT (US)

( * ) Notice: Subject to any disclaimer, the term of this patent is extended or adjusted under 35 U.S.C. 154(b) by 0 days.

(21) Appl. No.: 09/486,969

(22) PCT Filed: Aug. 21, 1998

(86) PCT No.: PCT/US98/17196

§ 371 Date: May 4, 2000

§ 102(e) Date: May 4, 2000

(87) PCT Pub. No.: WO99/13117

PCT Pub. Date: Mar. 18, 1999

(51) Int. Cl.[7] ..... C22C 9/02; C22C 9/06; H01R 13/03

(52) U.S. Cl. ..... 148/433; 420/472

(58) Field of Search ..... 420/472; 148/433

(56) References Cited

U.S. PATENT DOCUMENTS 4,732,731 A * 3/1988 Asai et al. ..... 420/473

5,286,444 A * 2/1994 Tomikawa et al. ..... 420/491

FOREIGN PATENT DOCUMENTS

| | | | |
|---|---|---|---|
| CN | 1060052 | * | 4/1992 |
| JP | 61213359 | * | 9/1986 |
| JP | 63266049 | * | 11/1988 |
| JP | 1025929 | * | 1/1989 |
| JP | 1162737 | * | 6/1989 |
| JP | 2122039 | * | 5/1990 |
| JP | 3031437 | * | 2/1991 |
| JP | 07126779 | * | 5/1995 |
| JP | 7150273 | * | 6/1995 |

OTHER PUBLICATIONS

Oya, Shigeo; Nakano, Kosaku, Effects of micro–segregation on inverse segregation in copper–tin alloys, Rep. Cast. Res. Lab., Waseda Univ. (1977), 28, 57–61 (provided abstract only).*

* cited by examiner

*Primary Examiner*—Sikyin Ip
(74) *Attorney, Agent, or Firm*—Sughrue Mion, PLLC

(57) ABSTRACT

A phosphor bronze alloy which contains 0.4 to 3.0 weight % Ni, 0.1 to 1.0 weight % Si, 0.01 to 0.35 weight % P, 1.0 to 11.0 weight % Sn with remainder being substantially Cu.

25 Claims, 2 Drawing Sheets

COPPER BASED ALLOY FEATURING PRECIPITATION HARDENING AND SOLID-SOLUTION HARDENING

This application claims priority to U.S. application Ser. No. 60/057,777 filed Sep. 5, 1997, the entire contents of which are incorporated by reference.

This invention relates to a copper alloy, particularly a copper alloy that is especially useful in electrical and electronic interconnection components and switch applications, including high temperature switching. This alloy shows special promise in "spring type" applications.

BACKGROUND OF THE INVENTION

Several families of copper alloys are known in various arts. For example, Mikawa et al., U.S. Pat. No. 5,041,176 discloses a copper alloy including from 0.1–10% nickel (Ni); 0.1–10% tin (Sn); 0.05–5% silicon (Si); 0.01–5% iron (Fe); and 0.0001–1% boron (B), by weight. This disclosure requires formation of an Ni-Si intermetallic compound homogeneously dispersed in the alloy. Fe is required for age hardening. However, at Fe concentrations greater than 5%, electrical conductivity is compromised and corrosion becomes a serious problem. B is incorporated into the alloy to improve corrosion resistance, hardness and strength. High hardness is achieved by precipitation hardening at a tempering temperature of 400° to 450° C. Si also serves as a deoxidizer.

Although the Mikawa alloy is suitable for use in electronic parts where good electrical conductivity, heat conductivity, strength, hardness, plating ability, soldering ability, elasticity, and corrosion resistance including resistance to acids are required, this alloy is of a different composition and displays different characteristics from those obtainable according to the instant invention.

Another comparison alloy is disclosed by Kubosono et al., U.S. Pat. No. 5,516,484. Kubosono et al. discloses copper-nickel based alloys that are processed using horizontal continuous casting with a graphite mold. The Ni—Cu alloy system is essentially a different alloy than the alloy of the instant invention. In this alloy copper (Cu) is an undesired impurity whose content must be kept below 0.02%. Kubosono et al., teaches that effects obtainable by addition of Si cannot be recognized if no B is present.

U.S. Pat. No. 5,334,346 to Kim et al. discloses a high performance copper alloy for electrical and electronic parts. The Kim alloy consists essentially of copper and 0.5 to 2.4% by weight Ni; 0.1–0.5% Si; 0.02 to 0.16% P; and 0.02 to 0.2% magnesium (Mg). Kim et al. discusses precipitation hardening where $Ni_2Si$ and $Ni_3P$ precipitate in the copper matrix. Any excess of free Si and P, is taught as causing formation of brittle intermetallic compounds which lead to peeling and cracking. Mg is proposed as a scavenger element to remove free Si and P. However, as content of Mg increases, conductivity and utility of the alloy are compromised. Zinc (Zn) and Fe are also disclosed as possible scavengers. This alloy does not contain Sn.

Hashizume et al., U.S. Pat. No. 5,064,611 discloses a process for producing a copper alloy that contains 1–8% Ni; 0.1–0.8% P; 0.6–1.0% Si; optionally, 0.03 to 0.5% Zn; and Cu. $Ni_5P_2$ and $Ni_2Si$ are disclosed as intermetallic compounds for increasing mechanical strength of the alloy with minimal decrease in electrical conductivity. Sn is not present in this alloy.

As an example of a copper-tin alloy, i.e., bronze, Asai et al., U.S. Pat. No. 5,021,105, discloses an alloy comprising 2.0–7.0% Sn; 1.0–6.0% Ni, cobalt (Co) or chromium (Cr); 0.1–2.0% Si; and Cu. This alloy may be processed to exhibit elongation of 3–20%; strength of 70–100 kg/mm$^2$; and electroconductivity from 10–30% IACS. Ni is disclosed as being important for strengthening; Cr is disclosed as improving hot rolling properties and heat resistance; and Co is disclosed as contributing to effective heat resistance. According to Asai et al. Sn content is limited to 7% by the hot rolling method used to process the alloy. Asai et al. does not disclose phosphorus (P) as a constituent. Accordingly, this alloy suffers similar limitations to Mikawa et al., as discussed above.

Similarly, Arita et al., U.S. Pat. No. 4,337,089, discloses a Cu—Ni—Sn alloy containing 0.5–3.0% Ni; 0.3–0.9% Sn; 0.01–0.2% P; 0.0–0.35% manganese (Mn) or Si; and Cu. This alloy features 60 kg/mm$^2$ tensile strength and elongation of more than 6% (i.e., to provide the mechanical property necessary for bend working) by combining heat treatment and cold rolling in its processing. In Arita et al., Si or Mn is incorporated to enhance strength. The low Sn content disclosed in Arita et al., however, does not provide the combined formability-strength properties of the instant invention.

Takeda et al., U.S. Pat. No. 5,132,083 teaches a laser padding material which is a powder containing 1–5% Ni; 0.2–5% Si; less than 1% ; less than 2% P; less than 3% Mn; and Cu. Sn and lead (Pb) are optional ingredients, at 8–15% for each. This powder can be laser processed to produce a copper laser padding material excellent in sliding-abrasion resistance. The chemistries involved in laser padding are not the same as in the alloy of the instant invention. For example, no rolling, hot or cold, is used to process the padding material.

A designation system for providing a means for defining and identifying coppers and copper alloys is known as UNS (Unified Numbering System). This system is in common use in North America and uses a five digit (recently expanded from three digit) numbering following a C prefix. The numbering system is not a specification, but rather a useful number code for identifying mill and foundry products. The C designations appearing below refer to the UNS numbers. The general art that includes alloys thus includes many patentable alloys that are similar in some respects in composition, but that display different desired properties depending on the specific content and processing of the alloy.

UNS alloy C85800 is a leaded yellow brass containing 1.5% Sn, 1.5% Pb, 31–41% Zn, 0.5% Fe, 0.05%Sb, 0.5% Ni (incl Co), 0.25% Mn, 0.05% As, 0.05% S, 0.01% P, 0.55% Al, 0.25% Si and 57.0% minimum Cu.

In the electronics industry, phosphor bronzes with required strength and formability are known that can be used up to 100° C. However, the need exists for alloys resistant to higher temperatures, e.g., of 120° C., 140° C. and temperatures up to or exceeding 150° C. Higher temperature applications will allow faster speed in electronic processing and allow the alloy to be used in higher temperature environments.

Accordingly, the present invention provides a phosphor bronze alloy with characteristics much improved over those known in the art. The invention provides an alloy that when processed has desired spring and strength properties and superior durability especially at higher temperatures at an economic price.

THE INVENTION

Figure 1:
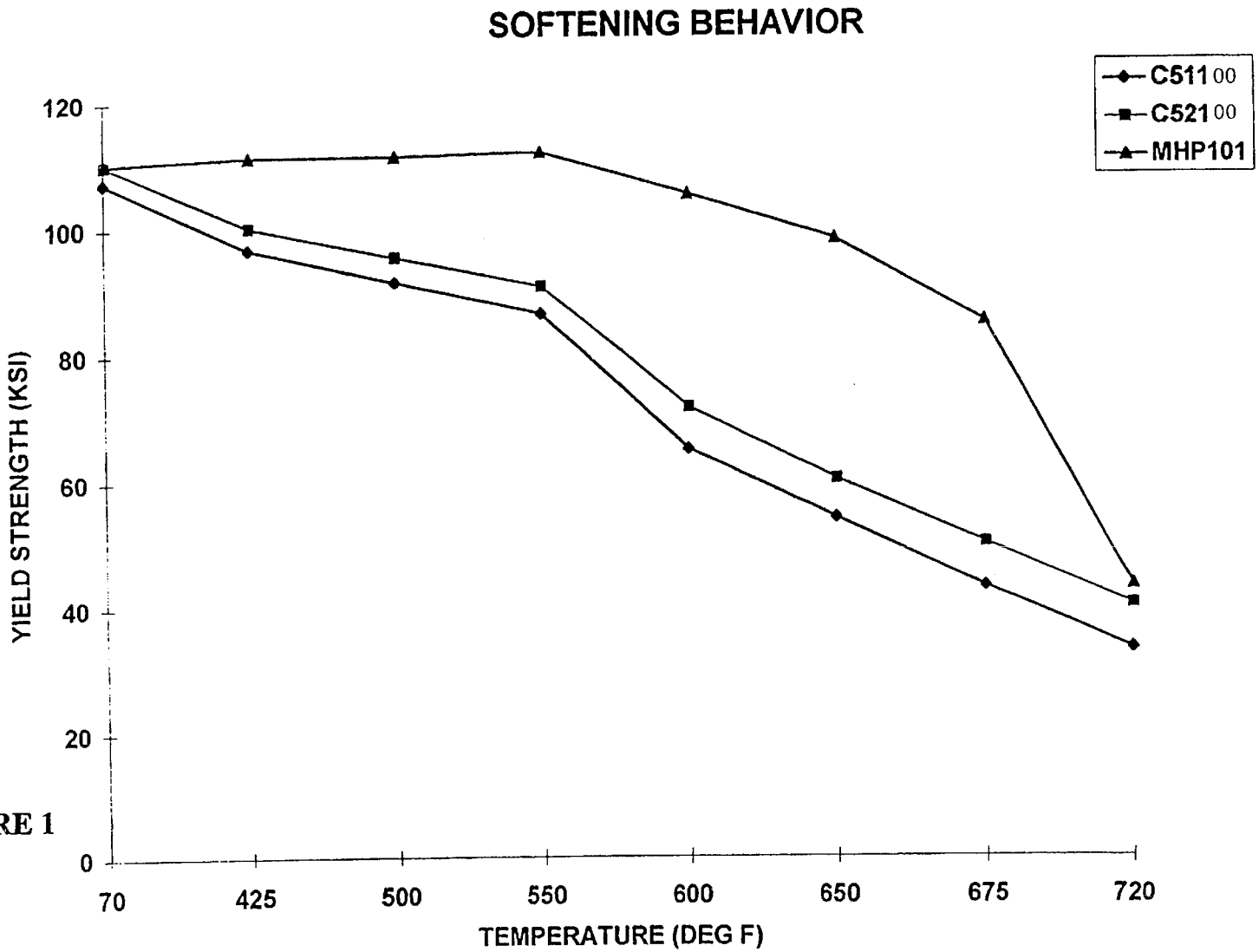
FIG. 1 depicts softening behavior data curves for alloy MHP101 of the Example and of comparative alloys.

A particle dispersion enhanced phosphor bronze in accordance with the present invention includes a nickel content of from 0.4 to 3.0% by weight; a Si content of from 0.1 to 1.0% by weight; a P content of from 0.01–0.35% by weight; a Sn content of 1.0–11.0% by weight and copper. Sn enhances formability at a given level of strength. P helps impart optimal spring and strength properties as well as providing fluidity in casting copper based alloys. P also aids in deoxidation of the melt. P is the primary deoxidizer of the melt. Si is not lost in uncontrolled quantities in the melting process, which permits maintaining a stoichiometrical relationship between Si and Ni in the alloy.

Sn content of below 8% and P content of 0.01–0.2% by wt. are especially preferred in some embodiments.

Solid solution hardening is contributed by tin, phosphorous and copper, while precipitation hardening resides in nickel silicide and nickel phosphides precipitated in the matrix.

Solid solution of a copper base occurs when the alloying element is dissolved to form a homogenous liquid solution. When the solution is frozen and subsequently rolled/annealed, the alloying metal goes into solution to form a solid solution. The alloying element thereby becomes an integral part of the matrix crystal.

Substitution of elements in solid solution tends to increase the strength of the metal as it decreases electrical conductivity. The increased strength is related to a greater resistance to slip. The solute atoms are different in size from the copper atoms, causing a distortion of the lattice structure that imparts slip resistance. That is, greater energy is required to distort the lattice.

Preliminary analysis indicates that this alloy is resistant to stress relaxation, i.e., time dependent decrease in stress in a solid under given constant constraints especially at elevated temperatures encountered in some applications. The phosphor bronze according to the instant invention has consistent mechanical properties, optimum yield strength and excellent formability. The alloy is especially useful in high temperature applications, e.g., where operational temperatures may reach 140° C., 150° C. or higher, for example, up to 200° C. in specific applications. The alloy is designed to be a high strength alloy with moderate conductivity. In these applications, no comparable alloy has been previously available.

The alloy family will have the strength and formability of known phosphor bronzes, but will exhibit superior resistance to stress relaxation especially at elevated temperatures.

In an exemplary process, the material for the alloy is mixed according to desired concentrations and melted in channel or coreless electric induction furnaces. The obtained melt is horizontally continuous cast through a graphite die. This process is sometimes referred to as horizontal thin strip continuous casting. Special enhanced cooling can be employed to assure proper quenching of solidified material, to maintain all solute in solution.

The preferred casting practice employs special enhanced cooling within the graphite die assembly to assure a sufficiently rapid quench of the just-solidified metal from its solidus temperature to a temperature below 450° C. This assures that the solute remains to a high degree (estimated at approx. 90%) in solution, and does not have time to significantly precipitate during the cooling phase.

This enhanced cooling involves the use of high thermal conductivity (minimum 0.77 cal/cm/sec) copper plates to which a high thermal conductivity graphite die (minimum 0.29 cal/cm/sec) has been bolted as per current standard art. The invention introduces a high conductivity gas such as Helium or Hydrogen or mixtures thereof, or carrier gases with significant concentrations of Helium and/or Hydrogen, between the copper plates and graphite plates of the assembly. The high conductivity gas replaces atmospheric $O_2/N_2$ in the copper/graphite interface, thereby improving the cooling action.

The cast material is surface milled and then rolled down to thinner gages. Heat treatments are imposed in the course of rolling to assure 1) maximum solution of alloying elements, and 2) precipitation of the dissolved alloying elements. The precipitate provides strength and resistance to stress relaxation.

Less cold rolling is required to achieve the same tensile strength as Sn concentration (solid solution content) of the alloy increases. Less cold rolling permits more subsequent forming operations.

After heat treatment, the material is for some applications further rolled to attain increased strength, and may or may not be stress relieved thermally and/or mechanically at finish.

In a further embodiment of the invention, improved solutioning of the solute is obtained by heat treating at elevated temperatures at the cast stage, or at intermediate stages.

The process stages in accordance with the instant invention can include the following protocols:

One embodiment (for those mills so equipped)

Cast

Mill

Homogenize (=rapid heat up/homogenize/quench). The homogenization assures maximum solutioning of alloying elements. The quench assures maximum solution is retained. Temperature attained is 800–950° C.

Roll

Precipitate anneal at 375–550° C. Roll to finish

Relief anneal for various tensile and yield strength conditions.

Another embodiment (for those mills so equipped)

Cast

Mill

Roll to intermediate gage

Homogenize anneal Roll

Precipitation anneal

Roll to finish

Relief anneal

Another embodiment (for maximum strength at the expense of some conductivity)

Cast

Mill

Homogenize

Roll

Rapid anneal with quench (may need multiple "anneal with quench" steps in process to reach light gages)

Roll

Mill hardening anneal

Another embodiment

Cast

Mill
Roll to intermediate gage
Homogenize
Roll
Rapid anneal with quench (may need multiple "anneal with quench" steps in process to reach light gages)
Roll Alternatively, a rapid cool can replace quenching in the above-described casting practice.

The invention overcomes problems previously plaguing the art wherein hot rolling technologies did not permit P to be used at levels as instantly claimed. Also the instant invention provides an alloy that can contain if desired, a wide range of Sn content, for example, greater than 7% Sn, (including 8–11% Sn in several embodiments) with excellent working properties and product characteristics. Although below 8% Sn content is preferred for greater electrical conductivity desired in some applications, higher-levels of Sn will provide greater strength desired in other applications. In contrast, many applications will demand that the Sn content be 8% by weight or less, for example, 7%, 5%, and possibly approaching 3%. For some applications, a 1% Sn content may prove advantageous due to its high electrical conductivity and moderate strength. Alloys with Sn content below 1% will have lower potential strength levels and will not achieve the contact forces required in some more demanding spring contact applications.

P levels of 0.01–0.20 may prove particularly advantageous in many applications.

Ni and Si in the phosphor bronze according to the invention allow improved strengths and will increase the alloy's resistance to stress relaxation at elevated temperatures where the alloy may be used.

The instant invention provides a metal alloy comprising by weight:

| | |
|---|---|
| Sn | 1.0–11.0% |
| Ni | 0.4–3.0% |
| Si | 0.1–1.0% |
| P | 0.01–0.35% |

Cu comprises the balance. Preferred embodiments of this invention may be limited to preferred subranges of various components, e.g., Sn content of below 8%, 1.0 to 1.5%, 2.1 to 2.7%, 4.7–5.3%, 1–7%, 7–11%, 7–8% or 7–9%, etc. Similarly, other constituents such as P may be preferably limited to, for example, 0.01–0.2%, 0.01 to 0.06%, 0.05–0.18 or 0.2, etc, Si content can be 0.22–0.30% or 0.4–0.5%. Ni content can be 1.3–1.7%, 2.5–3.0%, or 1.0–3.0%, etc.

Of course, the inventors contemplate that a small amount of impurities that are not economically avoided will be present.

In other preferred embodiments of the invention, this alloy consists essentially of, by weight:

| | |
|---|---|
| Sn | 1.0–11.0% |
| Ni | 0.4–3.0% |
| Si | 0.1–1.0% |
| P | 0.01–0.35%, or smaller preferred ranges of each element, with the balance being Cu. |

In a more preferred embodiment, the inventive alloy consists essentially of:

| | |
|---|---|
| Sn | 1.0–7.0% |
| Ni | 0.4–3.0% |
| Si | 0.1–1.0% |
| P | 0.01–0.2%, with the balance being Cu. Again, smaller specific subranges are contemplated as applications dictate. |

In yet other preferred embodiments of the invention, the alloy consists of, by weight:

| | |
|---|---|
| Sn | 1.0–11.0% |
| Ni | 0.4–3.0% |
| Si | 0.1–1.0% |
| P | 0.01–0.35%, or especially, |
| Sn | 1.0–7.0% |
| Ni | 1.0–3.0% |
| Si | 0.2–1.0% |
| P | 0.02–0.2%, in each case with the balance being Cu. |

Based on preliminary analysis, the alloys according to the instantly claimed invention will demonstrate improved properties, for example, conductivity and tensile strength, over those alloys known in the art. Devices incorporating the alloy will be more economical to produce and maintain and will demonstrate improved durability. Table 1 shows a comparison of exemplary alloys according to the invention, with several standard phosphor bronze alloys.

EXAMPLE

In one embodiment of the instant invention, an alloy designated alloy MHP101 was cast with the chemistry as follows:

Cu 95.67%, Sn 2.46%, P .057%, Ni 1.50%, Si 0.28% together with unavoidable impurities.

The material was processed to 0.0070" thick and had mechanical properties as follows in the bare conditions unless otherwise stated:

| | |
|---|---|
| Tensile strength | 91.9 ksi |
| Yield strength @.2 | 84.4 ksi |
| Elongation on 2" | 13.9% |
| Grain size | .010 mm |
| Conductivity | 31.1% I.A.C.S. |
| Good way bend (180 deg) | Flat at .690" wide, bare |
| Bad way bend (180 deg) | Radius .006" at .690" wide, bare |
| | Flat at .690" wide, tinned 40 microinches per side |
| Bad way bend (180 deg) | Flat at .020" wide, bare. |
| Modulus of Elasticity | 20 psi × $10^6$, tension |
| Density | .323 lbs/cu inch at 68° F. |

The softening behavior is shown in FIG. 1 compared with data of C51100 alloy (4Sn Phosphor Bronze) and C52100 (8% Sn Phosphor Bronze). The time at temperature was one hour.

Figure 2:
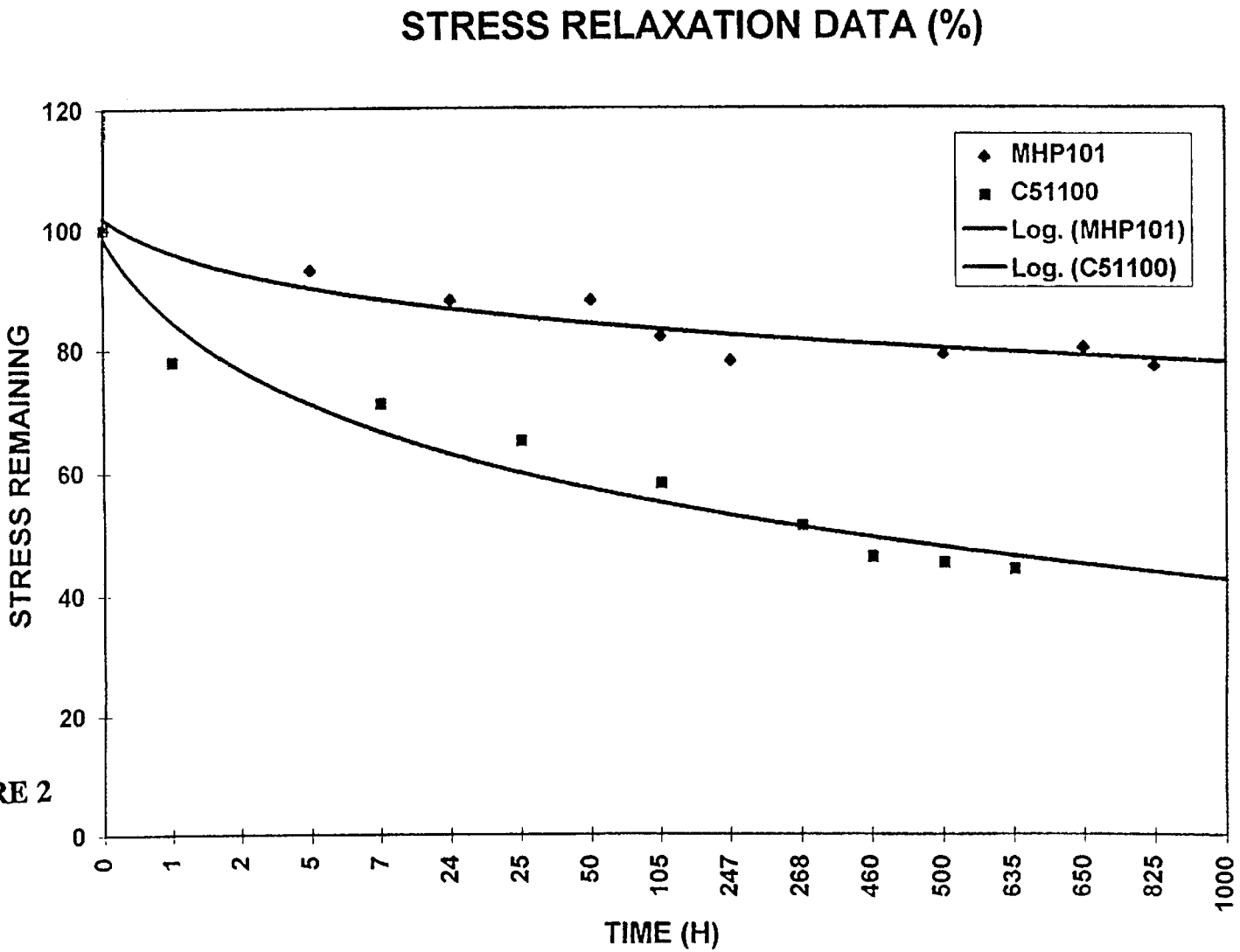
FIG. 2 depicts stress relaxation data curves for alloy MHP101 of the Example and of comparative alloys.

The stress relaxation behavior is shown in FIG. 2 compared with C51100 alloy. The test stress was 80% of initial stress, and the initial stress in the test sample was 88ksi. The test temperature was 150° C.

Expected electronic application guide data for MHP101 and other alloys according to the instant invention compared to similar UNS designated alloys are shown in Table 1.

TABLE 1

ELECTRONIC APPLICATIONS ALLOY GUIDE

| Alloy | Chemistry (Nominal %) | Conductivity (% IACS) | Tensile Strength (KSI)/n/mm$^2$ Hard | Spring |
|---|---|---|---|---|
| *MHP 2 | Cu, 1.5 Sn, 1.5 Ni, 0.30 Si, 0.2 P max | 40 | 70/483 min** | 85/586 min |
| *MHP 5 | Cu, 2.4 Sn, 0.5 Ni, 0.10 Si, 0.2 P max | 35 | 70/483 min | 85/586 min |
| *MHP 105 | Cu, 5.0 Sn, 1.5 Ni, 0.3 Si, 0.2 P max | 13 | 82/565 | 100/690 |
| C 51000 | Cu, 5 Sn, 0.2 P | 15 | 76–91/ 524–628 | 95–110/ 655–759 |
| *MHP 101 | Cu, 2.4 Sn, 1.5 Ni, 0.3 Si, 0.2 P max | 30 | 75/517 | 90/620 |
| C 51100 | Cu, 4.2 Sn, 0.2 P | 20 | 72–87/ 496–600 | 91–105/ 628–724 |
| C 51900 | Cu, 6 Sn, 0.2 P | 14 | 80–96/ 552–662 | 99–114/ 683–786 |
| *MHP 108 | Cu, 7.5 Sn, 1.5 Ni, 0.3 Si, 0.2 P max | 10 | 90/620 | 110/758 |
| C 52100 | Cu, 8 Sn, 0.2 P | 13 | 85–100/ 586–690 | 105–119/ 724–821 |
| *MHP 109 | Cu, 7.5 Sn, 2.75 Ni, 0.45 Si, 0.2 P max | 9 | 95/655 | 110/758 |
| *MHP 100 | Cu, 1.5 Ni, 1.25 Sn, 0.3 Si, 0.2 P max | 40 | 70/483 | 85/586 |
| C 50500 | Cu, 1.3 Sn, 0.35 P max | 48 | 59/407 | 70/483 |
| *MHP 4 | Cu, 7.5 Sn, 0.5 Ni, 0.10 Si, 0.2 P max | 12 | 85/586 min | 105/724 min |

*New alloy composition and expected properties.
**min = minimum
"MHP" is a trademark of The Miller Company, the assignee of the invention of the subject patent application.

The data collected for MHP101 confirm that alloy formulations of the instant invention provide resistance to stress relaxation at higher temperatures than the current offering to standard Phosphor Bronze alloys such as the C51100 used in the comparison. In addition, strengths equal to higher tin-containing Phosphor Bronzes can be achieved with increased electrical conductivity.

The alloy MHP101, an example of the alloys of the instant invention, is thus shown to have excellent formability properties.

It also has a higher modulus of elasticity which offers the connector designer a material with increased contact forces for a given deflection.

The invention also provides the above described alloy for use as a casting material.

The invention also includes embodiments for certain applications that may demand smaller ranges of constituents, e.g., 0.02–0.2% P, than described above. All subranges within the above-described ranges are contemplated as part of the invention.

Sn over 7%, for example, nominal. Sn content of 8%, 9%, or 10% will add strength to the alloy. The alloy will also have better formability at a given tensile strength.

The invention especially includes embodiments where the alloy displays properties of solid solution hardening, and precipitation hardening, and dispersion hardening.

Another aspect of the invention is a phosphor bronze casting. The product resulting from the processing of the casting is useful as a material for electrical lead conductor applications. Such applications include those relating to integrated circuits and those encountered in the automotive industry such as engine compartment circuitry.

What is claimed is:

1. An electronic connector or an electronic switch comprising a phosphor bronze alloy consisting of 0.4 to 3.0 wt. % Ni, 0.1 to 1.0 wt. % Si, 0.01 to 0.06 wt. % P, 1.0 to 11.0 wt. % Sn and the remainder being Cu.

2. The electronic connector or electronic switch of claim 1 wherein the Ni content is 1.0 to 3.0 wt. %.

3. The electronic connector or electronic switch of claim 1 wherein the Sn content is below 8 wt. %.

4. The electronic connector or electronic switch of claim 1 wherein the Si content is 0.22–0.30 wt. %.

5. The electronic connector or electronic switch of claim 1 wherein the Si content is 0.4–0.5 wt. %.

6. The electronic connector or electronic switch of claim 1 wherein the Sn content is 1–7 wt. %.

7. The electronic connector or electronic switch of claim 1 wherein the Sn content is 1.0–1.5 wt. %.

8. The electronic connector or electronic switch of claim 1 wherein the Sn content is 2.1–2.7 wt. %.

9. The electronic connector or electronic switch of claim 1 wherein the Sn content is 4.7–5.3 wt. %.

10. The electronic connector or electronic switch of claim 1 wherein the Sn content is 7–11 wt. %.

11. The electronic connector or electronic switch of claim 1 wherein the Sn content is 7–8 wt. %.

12. The electronic connector or electronic switch of claim 1 wherein the P content is 0.05–0.06 wt. %.

13. The electronic connector or electronic switch of claim 1 wherein the Ni content is 1.3–1.7 wt. %.

14. The electronic connector or electronic switch of claim 1 wherein the Ni content is 2.5–3.0 wt. %.

15. The electronic connector or electronic switch of claim 1 wherein the Ni content is 1.3–1.7 wt. %, the Si content is 0.22–0.30 wt. %, the P content is 0.01–0.06 wt. %.

16. The electronic connector or electronic switch of claim 15 wherein the Sn content is 1.0–1.5 wt. %.

17. The electronic connector or electronic switch of claim 1 wherein the Ni content is 2.5–3.0 wt. %, the Si content is 0.4–0.5 wt. %, the P content is 0.01–0.06 wt. % and the Sn content is 7.0–8.0 wt. %.

18. The electronic connector or electronic switch of claim 1 consisting of 1.5 wt. % Ni, 0.28 wt. % Si, 0.057 wt. % P, 2.46 wt. % Sn and the remainder being Cu.

19. The electronic connector or electronic switch of claim 1 which is an electronic switch.

20. The electronic connector or electronic switch of claim 1 wherein the Sn content is 1.25 wt. % nominal to 11.0 wt. %.

21. The electronic connector or electronic switch of claim 15 wherein the Sn content is 2.1–2.7 wt. %.

22. The electronic connector or electronic switch of claim 15 wherein the Sn content is 4.7–5.3 wt. %.

23. The electronic connector or electronic switch of claim 15 wherein the Sn content is 7.0–8.0 wt. %.

24. The electronic connector or electronic switch of claim 1 which is an electronic connector.

25. A phosphor bronze casting comprising a phosphor bronze alloy consisting of 0.4 to 3.0 wt. % Ni, 0.1 to 1.0 wt. % Si, 0.01 to 0.06 wt. % P, 1.0 to 11.0 wt. % Sn and the remainder being Cu.

* * * * *